United States Patent [19]

Nettel

[11] Patent Number: 4,823,411

[45] Date of Patent: Apr. 25, 1989

[54] CLEANOUT EXTENSION ADAPTOR

[76] Inventor: Hans Nettel, P.O. Box A-80547, San Diego, Calif. 92138

[21] Appl. No.: 661,980

[22] Filed: Oct. 18, 1984

Related U.S. Application Data

[63] Continuation of Ser. No. 565,535, Dec. 27, 1983, abandoned, which is a continuation of Ser. No. 402,201, Jul. 26, 1982, abandoned.

[51] Int. Cl.[4] ..... E03D 11/00

[52] U.S. Cl. ..... 4/255; 285/42; 138/89

[58] Field of Search ..... 138/89; 4/255; 137/362; 285/42, 58, DIG. 2

[56] References Cited

U.S. PATENT DOCUMENTS

| | | | |
|---|---|---|---|
| 839,165 | 12/1906 | Lund | 138/89 |
| 2,911,001 | 11/1959 | Fuller | 137/362 |
| 3,148,708 | 9/1964 | Panella | 138/89 |
| 3,285,289 | 11/1966 | Titus | 138/89 |
| 3,412,759 | 11/1968 | Potter et al. | 138/89 |
| 3,509,918 | 5/1970 | Muzinich | 138/89 X |
| 3,749,131 | 7/1973 | Burger | 138/89 |
| 3,993,102 | 11/1976 | Polster et al. | 138/89 |
| 4,360,041 | 11/1982 | Hagan et al. | 138/89 |
| 4,620,330 | 11/1986 | Izzi, Sr. | 4/288 |

*Primary Examiner*—Charles E. Phillips

*Attorney, Agent, or Firm*—Baker, Maxham & Jester

[57] ABSTRACT

A cleanout extension adaptor for insertion into a cleanout extension construction in a plumbing arrangement. The cleanout extension adaptor includes a cylindrical body with a small, thin lip on the top for seating on the top of a cleanout extension. The cleanout extension adaptor has internal threads which accommodate a threaded plug that is contained within the confines of the cleanout extension when installed. The cleanout extension adaptor permits cutting the cleanout extension so that it is even with the surrounding surface. When the plug is inserted into the cleanout extension adaptor, the cleanout extension and plug are substantially even with the surrounding surface. This avoids cutting out or altering the surrounding surface in any way.

7 Claims, 1 Drawing Sheet

CLEANOUT EXTENSION ADAPTOR

This is a continuation of application Ser. No. 565,535 filed Dec. 27, 1983, which is a continuation of Ser. No. 402,201 filed July 26, 1982.

BACKGROUND OF THE INVENTION

The present invention relates to a cleanout extension adaptor. All commercial buildings, hospitals, homes, etc. must have cleanouts for the sewer lines. The pipe used in the sewer or drain line and in the cleanout extension is usually plastic. A typical installation has a sewer line under a cement floor with a cleanout extension extending to floor level. The plumber measures the distance from the sewer line to where the top of the floor is expected to eventually be in order to have the cleanout extension positioned somewhat evenly with the top surface of the floor. In most every instance, the top of the floor and the top of the cleanout extension differ significantly in position. The floor level than has to be broken out around the cleanout extension to attach a cap to the cleanout extension and the floor is then restored. This generally requires two different types of contractors and is cumbersome and costly. An alternative conventional approach is to leave extra length on the cleanout extension and pour the floor around the cleanout extension. The cleanout extension is the cut off at floor level, and a portion of the floor is removed around the cleanout extension to provide an open pocket. An external cap is then placed over the cleanout extension. The trade has long sought better ways to make the cleanout extension even with the floor to provide an attractive appearance when the floor is finished. This same problem exists with cleanout extensions in wall structures, road surfaces and the like.

It is an object of the present invention to provide a new and improved cleanout extension adaptor that is simple and inexpensive to make and use.

It is another object of the present invention to provide a new and improved cleanout extension adaptor that enables the surrounding surface to be finished to the level of the cleanout extension and remain intact after the cleanout extension is installed.

SUMMARY OF THE INVENTION

The above objects are accomplished by a cleanout extension adaptor for insertion into the end of the cleanout extension and having lip means on the top adapted to seat on top of the cleanout extension. The cleanout extension adaptor includes internal threads for accepting a plug which is level with the surrounding surface when installed. Means is provided on the cleanout extension adaptor to eliminate catching of a clean out tool when it is used.

DESCRIPTION OF THE INVENTION

Figure 1:
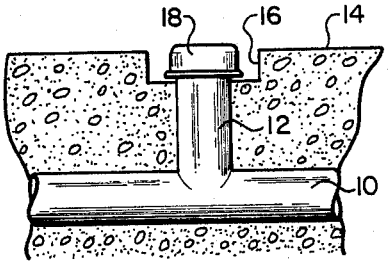
FIG. 1 PRIOR ART
FIG. 1 is a sectional elevation of a conventional cleanout extension construction in a basement floor.

An example of the prior art construction is shown in FIG. 1 of the drawings. A drain line is shown at 10 with a cleanout extension 12 extending vertically therefrom. The cleanout extension 12 was either measured to match the top of the floor 14 or it was left long and then cut off after the floor 14 was poured. In either event, a portion of the floor 14 is removed to provide a clearance pocket 16. A threaded collar (not shown) is placed in the pocket and fixed to the cleanout extension. The external cap 18 is then affixed to the collar. This is costly and unwieldy.

Figure 2:
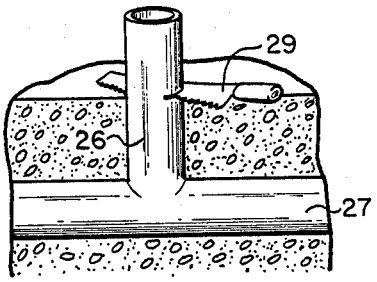
FIG. 2 is a view showing the cleanout extension being cut level with the surrounding floor prior to inserting the cleanout extension adaptor of the present invention.

FIG. 2 demonstrates a cleanout extension 26 extending from a sewer 27 and being cut at the level of the cement floor 28, which has been poured and has set.

Figure 3:
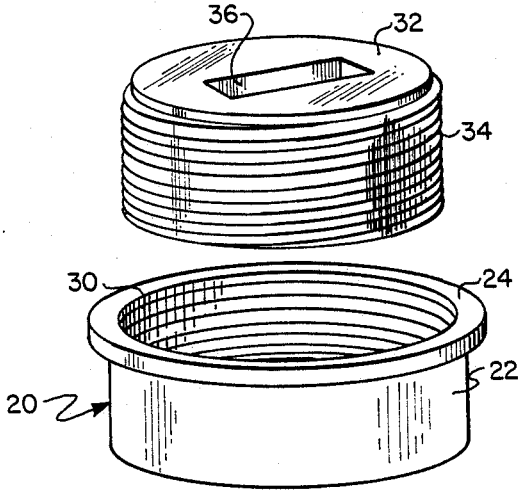
FIG. 3 is an exploded view of the cleanout extension adaptor and plug of the present invention.
Figure 4:
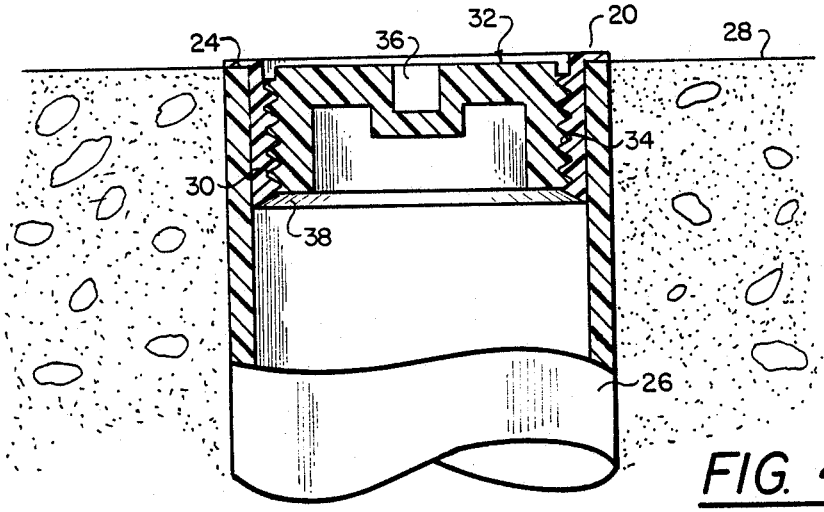
FIG. 4 is a sectional elevation of a cleanout extension with the cleanout extension adaptor and plug of the present invention installed in place.

The cleanout extension adaptor of the present invention is shown at 20 in FIGS. 3 and 4 of the drawings. The floor 28 is poured around the cleanout extension 26 and the cleanout extension 26 is cut off substantially even with the floor with saw 29. The cleanout extension adaptor 20 is formed of hard plastic such as polyvinylchloride and includes a cylindrical body 22 having a small, thin lip 24 at the top that is adapted to engage and seat on the top end of the cleanout extension 20. The external diameter of the cleanout extension adaptor 20 is a few thousandths of an inch less than the internal diameter of the plastic cleanout extension 26 shown in FIG. 3 of the drawings. Cleanout extensions are produced with internal diameters meeting tolerances in accordance with the class or schedule of the cleanout extension. A quick drying adhesive is applied to the cylindrical body 22 of the cleanout extension adaptor and the cleanout extension adaptor is inserted into the top of the cleanout extension 26. The lip 24 retains the cleanout extension adaptor 20 in position while the adhesive sets. The lip 24 is coextensive with the external diameter of the cleanout extension 26. The lip 24 can be made quite thin such as one thirty-seconds of an inch for example and can be peeled away after the cleanout extension adaptor 20 is installed if desired.

The cleanout extension adaptor 20 has a generally tubular cylindrical configuration includes a through bore with internal threads 30. A sealing plug 32 includes external threads 34 which mate with the threads 30 in the cleanout extension adaptor 20. The sealing plug 32 can be quickly and easily threaded in place by inserting a tool such as a screwdriver in the slot 36 formed in the top of the sealing plug 32.

The bottom of the cleanout extension adaptor 20 is beveled at 38 to permit a clean out tool to be pulled through the cleanout extension 26 without hanging up on the cleanout extension adaptor 20.

Although the cleanout extension adaptor of the present invention has been explained with respect to a floor cleanout extension, it will be apparent that the cleanout extension could be located in other constructions such as a wall, street, driveway of the like.

The construction of the present invention is simple and inexpensive and provides a significant cost saving in the installation of a cleanout extension.

Having thus described my invention, I claim:

1. A cleanout extension adaptor for use in the flush mounting of a cleanout extension, comprising:

a cylindrical body having an axial throughbore and an external diameter that is slightly less than the internal diameter of the cleanout extension;

a radially outwardly extending lip on the top of said cylindrical body for extending over and engaging the top edge of said cleanout extension for positioning and supporting the cleanout extension adaptor in position when inserted into said cleanout extension;

means for affixing said cleanout extension adaptor to the interior of said cleanout extension; and means on the interior of said cleanout extension adaptor for seating a sealing plug so that said sealing plug is substantially even with the area surrounding the top of the cleanout extension.

2. A cleanout extension adaptor according to claim 1 wherein internal threads are provided on said cleanout extension adaptor for mating with external threads on the sealing plug.

3. A cleanout extension adaptor according to claim 2 wherein the bottom of said cylindrical body is tapered to avoid obstructing a cleanout tool when the cleanout tool is pulled through the cleanout extension.

4. A cleanout extension adaptor according to claim 1 that is formed of a hard plastic.

5. A cleanout extension adaptor according to claim 1 wherein said lip is thin enough to be peeled off the cleanout extension adaptor after the cleanout extension adaptor is fixed in position on said cleanout extension.

6. The method of installing and sealing a cleanout extension so that it is substantially even with the surrounding surface without disturbing the surrounding surface, comprising the steps of:

cutting the cleanout extension to a height that is substantially level with the surrounding surface;

selecting and mounting an adaptor in the top portion of said cleanout extension to receive a sealing plug within the confines of said cleanout extension;

selecting said adaptor to have a generally tubular configuration with an internal threaded bore and an outer diameter to fit within the bore of the cleanout extension and to have an outwardly extending lip for engaging and overlapping the cut end of the cleanout extension for providing a finish to said cut end and for positioning and supporting said adaptor; and inserting a threaded sealing plug into the cleanout extension so that the top of the sealing plug is substantially level with the surround surface.

7. A cleanout extension adaptor for use in the flush mounting of a cleanout extension, comprising:

a cylindrical hard plastic body having a top edge and a bottom edge with an external diameter that is slightly less than the internal diameter of the cleanout extension;

an outwardly extending annular lip having a thickness of about one-thirty second of an inch on the top edge of said cleanout extension adaptor for holding and positioning the cleanout extension adaptor, wherein the bottom edge of said cylindrical body is tapered to avoid obstructing a cleanout tool when the cleanout tool is pulled through the cleanout extension;

thread means on the interior of said cleanout extension adaptor for seating a threaded sealing plug so that said sealing plug is substantially even with the area surrounding the top of the cleanout extension.

* * * * *

US004823411B1

REEXAMINATION CERTIFICATE (1844th)

United States Patent [19]

Nettel

[11] B1 4,823,411

[45] Certificate Issued Nov. 10, 1992

[54] CLEANOUT EXTENSION ADAPTER

[76] Inventor: Hans Nettel, P.O. Box A-80547, San Diego, Calif. 92138

Reexamination Request:
No. 90/001,879, Nov. 2, 1989

Reexamination Certificate for:

| | |
|---|---|
| Patent No.: | 4,823,411 |
| Issued: | Apr. 25, 1989 |
| Appl. No.: | 661,980 |
| Filed: | Oct. 18, 1984 |

Related U.S. Application Data

[63] Continuation of Ser. No. 565,535, Dec. 27, 1983, abandoned, which is a continuation of Ser. No. 402,201, Jul. 26, 1982, abandoned.

[51] Int. Cl.[5] ..... E03D 11/00

[52] U.S. Cl. ..... 4/256.1; 285/42; 138/89

[58] Field of Search ..... 4/255; 137/362; 138/89; 285/42, 58, DIG. 2; 220/3.4, 3.3, 3.7, 3.8

[56] References Cited

U.S. PATENT DOCUMENTS

| | | | |
|---|---|---|---|
| 207,246 | 8/1878 | Burke . | |
| 343,933 | 6/1886 | Walker . | |
| 1,175,028 | 3/1916 | Walwig . | |
| 1,224,603 | 5/1917 | Clark . | |
| 1,436,331 | 11/1922 | Ayling . | |
| 1,513,637 | 10/1924 | Schwartz . | |
| 1,789,928 | 1/1931 | Wackman . | |
| 1,792,345 | 2/1931 | Williams . | |
| 1,945,707 | 2/1934 | Sharp | 138/89 |
| 1,951,645 | 3/1934 | Boosey . | |
| 2,658,434 | 11/1953 | Miller | 94/34 |
| 2,717,758 | 6/1955 | Spool | 138/89 |
| 2,847,140 | 8/1958 | Voss . | |
| 3,148,708 | 9/1964 | Panella | 138/89 |
| 3,153,118 | 10/1964 | Clark | 174/48 |
| 3,343,704 | 9/1967 | Terry | 220/3.4 |
| 3,363,799 | 1/1968 | Zurcher et al. . | |
| 3,412,759 | 11/1968 | Potter et al. . | |
| 3,612,338 | 10/1971 | Ekman . | |
| 3,749,131 | 7/1973 | Burger . | |
| 3,952,340 | 4/1976 | Auschera . | |
| 3,972,440 | 8/1976 | Warren | 220/18 |
| 3,993,102 | 11/1976 | Polster et al. . | |
| 4,090,267 | 4/1976 | Auschera . | |
| 4,092,745 | 6/1978 | Oropallo . | |
| 4,109,327 | 8/1978 | Jones . | |
| 4,146,939 | 4/1979 | Izzi . | |
| 4,244,484 | 1/1981 | Guritz et al. . | |
| 4,246,859 | 1/1981 | Beckerer, Jr. | 114/201 R |
| 4,329,744 | 6/1982 | Auschera . | |
| 4,360,041 | 11/1982 | Hagan et al. . | |
| 4,506,705 | 4/1985 | Thompson . | |

FOREIGN PATENT DOCUMENTS

| | | |
|---|---|---|
| 507685 | 12/1953 | Belgium . |
| 538274 | 3/1957 | Canada . |
| M23680 | 6/1956 | Fed. Rep. of Germany . |
| 953944 | 12/1956 | Fed. Rep. of Germany . |

OTHER PUBLICATIONS

Trojan catalog sheets dated Jan. 1, 1981 (four pages).
Amvit Stopper specification Engineering News Mar. 16, 1967 (two pages).
Stopper Installation Instructions, 1982 (1 page).

*Primary Examiner*—Charles E. Phillips

[57] ABSTRACT

A cleanout extension adaptor for insertion into a cleanout extension construction in a plumbing arrangement. The cleanout extension adaptor includes a cylindrical body with a small, thin lip on the top for seating on the top of a cleanout extension. The cleanout extension adaptor has internal threads which accommodate a threaded plug that is contained within the confines of the cleanout extension when installed. The cleanout extension adaptor permits cutting the cleanout extension so that it is even with the surrounding surface. When the plug is inserted into the cleanout extension adaptor, the cleanout extension and plug are substantially even with the surrounding surface. This avoids cutting out or altering the surrounding surface in any way.

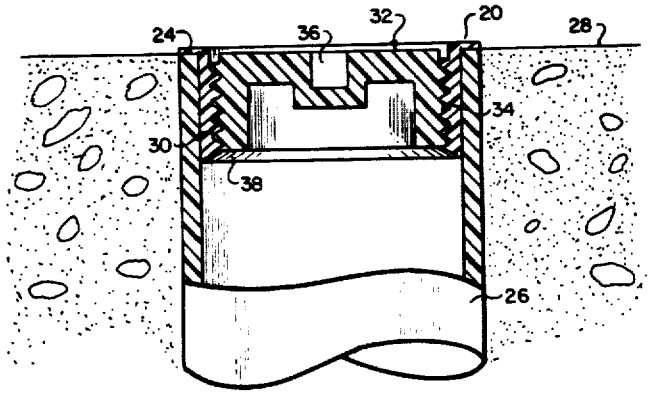

REEXAMINATION CERTIFICATE ISSUED UNDER 35 U.S.C. 307

THE PATENT IS HEREBY AMENDED AS INDICATED BELOW

AS A RESULT OF REEXAMINATION, IT HAS BEEN DETERMINED THAT:

The patentability of claims 5 and 7 is confirmed.

Claims 1–4 and 6 are cancelled.

* * * * *